United States Patent [19]

Ellingson, Jr.

[11] 4,096,665

[45] Jun. 27, 1978

[54] WINDOW SEALING STRUCTURE

[76] Inventor: Chester W. Ellingson, Jr., 13909 Frontier Ln., Burnsville, Minn. 55337

[21] Appl. No.: 776,127

[22] Filed: Mar. 10, 1977

[51] Int. Cl.[2] ..... E06B 7/16; E05D 13/00

[52] U.S. Cl. ..... 49/475; 49/414; 49/495

[58] Field of Search ..... 49/485, 475, 495, 423, 49/415, 414, 416, 419, 428, 436, 440

[56] References Cited

U.S. PATENT DOCUMENTS

| | | | |
|---|---|---|---|
| 1,980,313 | 11/1934 | Axe | 49/416 |
| 3,145,433 | 8/1964 | Jones | 49/414 |
| 3,483,658 | 12/1969 | Dallaire | 49/419 |
| 3,518,792 | 7/1970 | Williamson et al. | 49/495 X |

FOREIGN PATENT DOCUMENTS

| | | | |
|---|---|---|---|
| 117,609 | 1969 | Norway | 49/475 |

*Primary Examiner*—Philip C. Kannan
*Attorney, Agent, or Firm*—Leo Gregory

[57] ABSTRACT

This invention relates to an improvement in a weather seal between a sash and an adjacent side of a window frame and more particularly relates to a weather seal which increases in sealing effect under the impact of wind pressure and consists of a jamb strip having a portion projecting outwardly of the side of a window frame alongside the adjacent side rail of a sash and a flexible weather strip is carried by said projection angled across the juncture of the side of the window frame and sash rail, the strip being positioned to be drawn against the jamb and sash rail, and the strip being pressed further thereagainst for increased sealing effect under the impact of wind pressure. The strip permits free movement of the sash without lessening its sealing effect.

5 Claims, 5 Drawing Figures

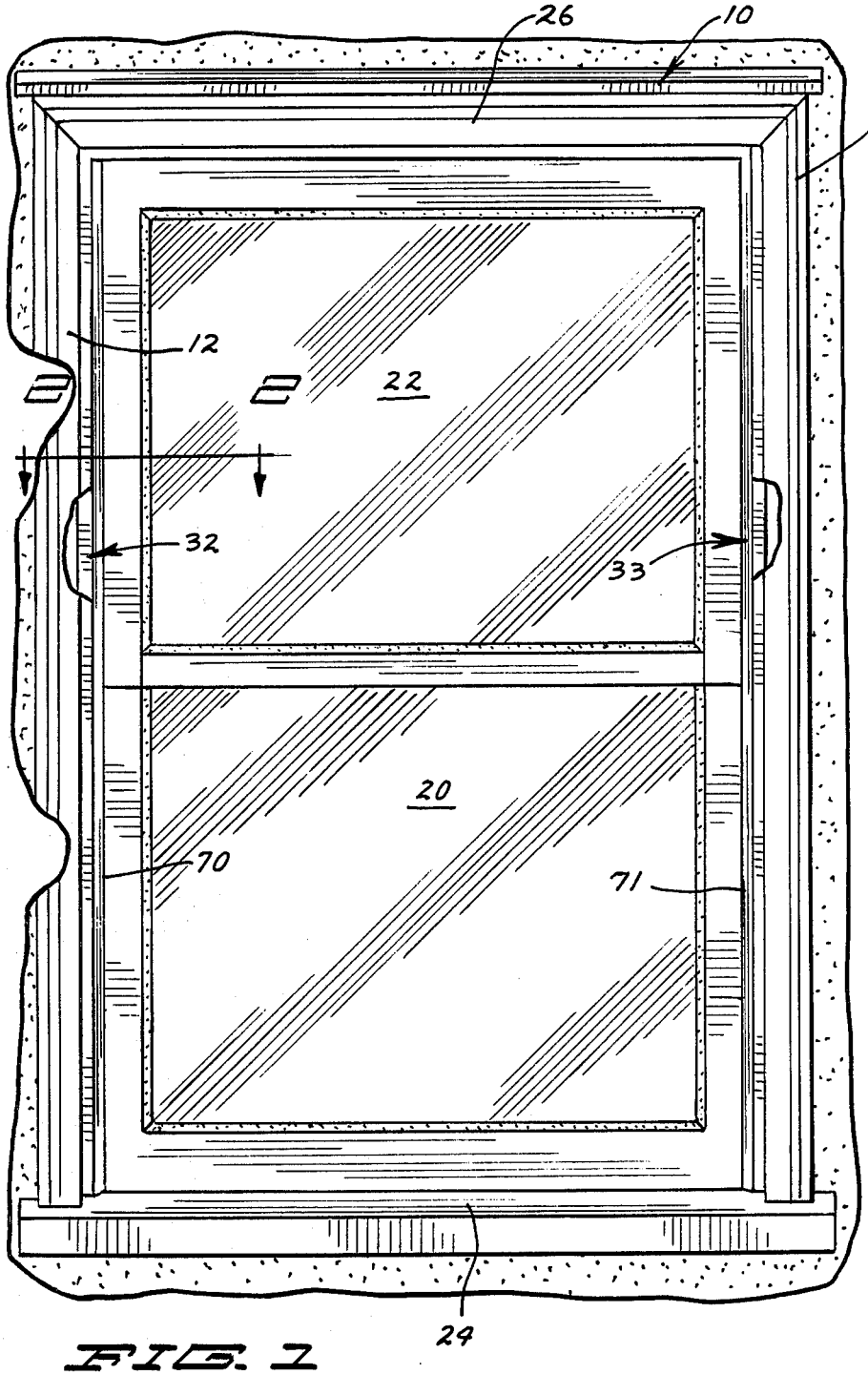
FIG. 1
FIG. 3
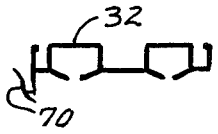
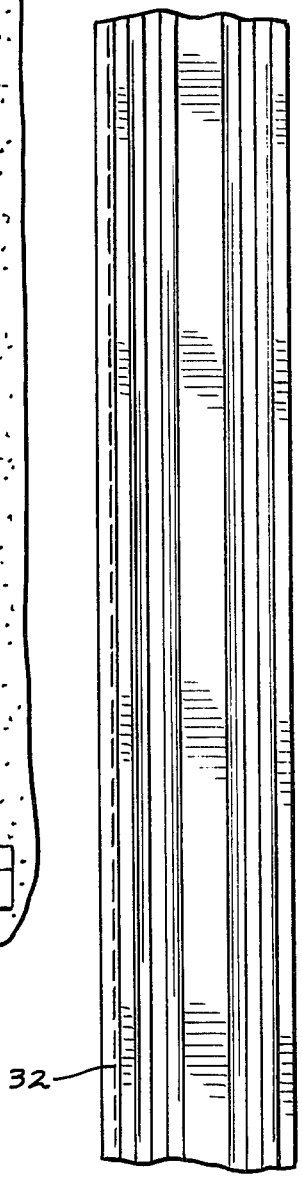
FIG. 4

WINDOW SEALING STRUCTURE

BACKGROUND AND SUMMARY OF THE INVENTION

Various structures have been devised to prevent the passage of air between the side jambs of a window frame and the sash carried thereby. Air passes very readily through the smallest of cracks or spaces.

It is desirable to provide a positive weather seal at the juncture of side rails of a sash and the adjacent window frame whereby under the impact of wind pressure the seal is caused to increase its sealing effect.

It is an object of this invention therefore to provide a positive weather seal to keep air from passing through the space between the side rails of a sash and the adjacent side jambs of a window frame.

It is another object of this invention to provide a flexible seal disposed at the juncture of a sash and the side jamb of a window frame which seal will yield to the impact of wind pressure to become a more secure seal.

It is a further object of this invention to provide a side jamb strip inserted into a window frame at either side of the sash therein, said jamb strips each having a projection outwardly along each side of the sash and carried at the free end portions of said projections are flexible weather seal strip members hingedly secured to said projections and being angularly disposed to have side portions thereof respectively bearing against the adjacent sash rails and sides of the window frame.

These and other objects and advantages of the invention will be set forth in the following description made in connection with the accompanying drawings in which like reference characters refer to similar parts throughout the several views and in which:

FIG. 1 is a view in front elevation with portions being broken away;

FIG. 3 is a plan view of an end portion of a detail of structure;

FIG. 4 is a view similar to FIG. 3 showing said detail of structure in front elevation.

DESCRIPTION OF A PREFERRED EMBODIMENT

Figure 2:
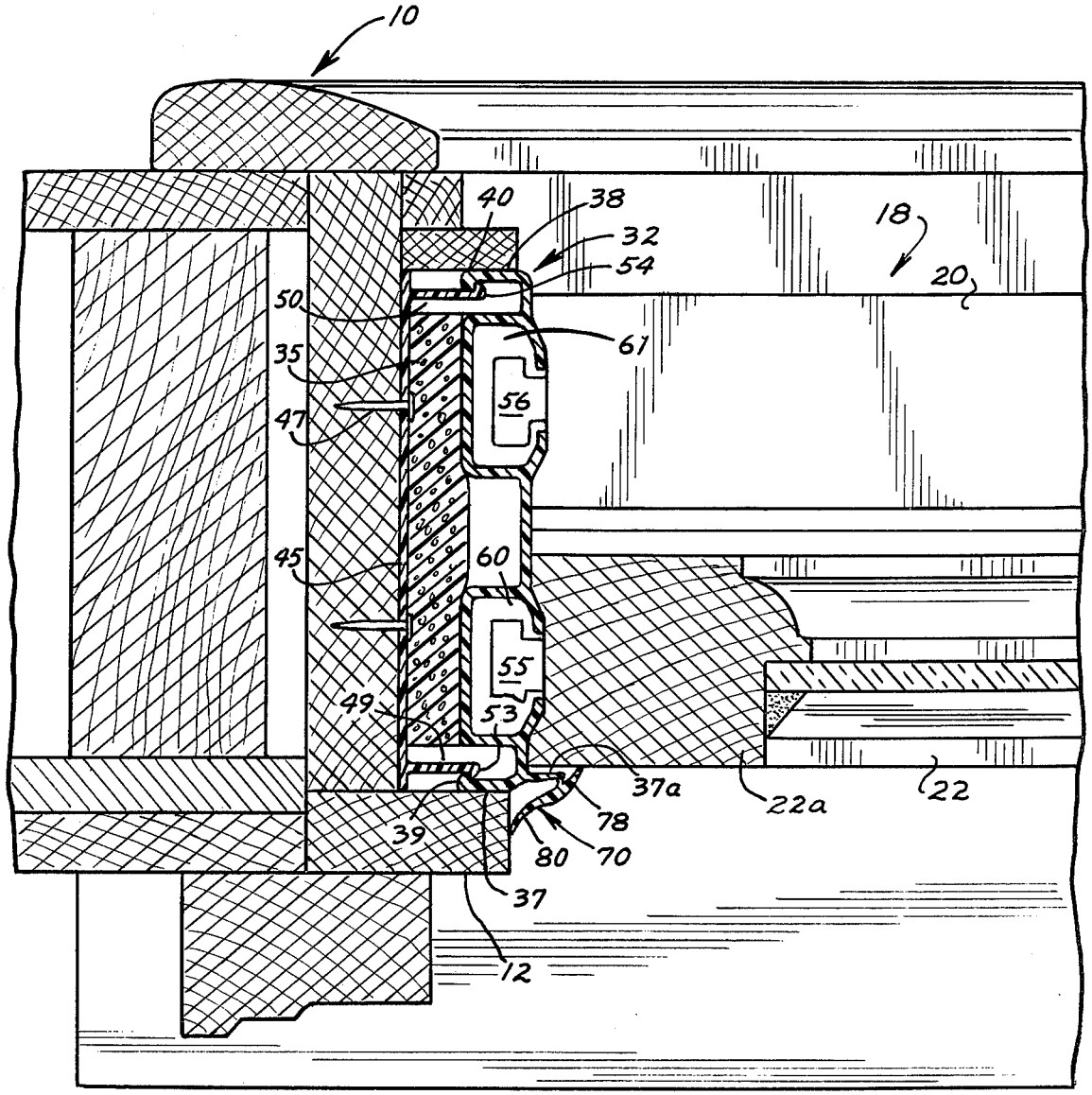
FIG. 2 is a view on an enlarged scale in horizontal section taken on lined 2—2 of FIG. 1 as indicated.

Referring to the drawings, a window frame 10 of conventional design is shown having sides 12 and 14 and hung therein is a double sash window 18 comprising a lower sash 20 and an upper sash 22 and said frame has a sill 24 and a head rail 26.

Positioned on said window frame are weather seal members 70 and 71 of which seal member 70 will be further described as representative of both.

Disposed within said window frame 10 at each side thereof are side jambs or jamb members 32 and 33 having said sash 20 and 22 therebetween. Said jamb 32 and related structure will be described as representative of both jambs.

Said jamb 32 is extruded as of fairly rigid plastic material such as polyvinyl chloride in the form or configuration as illustrated and underlying the same and secured thereto as by a suitable adhesive is an expanded foam cushion strip 35. Said jamb as shown in FIG. 2, has a pair of end walls 37 and 38 spaced therefrom and extending inwardly of the window frame 10 and have formed at their inner ends inwardly projecting shoulders 39 and 40.

A retainer clip 45 formed as a channel member is secured within said window frame underlying said jamb 32 and is secured as by nails 47 and has a pair of inset outwardly projecting arms 49 and 50 having oppositely or outwardly facing projecting shoulders 53 and 54 adapted to engage said shoulder portions 39 and 40 as illustrated in FIG. 2. Thus said retainer clip retains the jamb 32 in operating position permitting it to have transverse yielding movement as the sash are moved.

The jamb 32 has spring loaded sash balance clip members 55 and 56 to support the sash and the same are merely indicated in the channels 60 and 61 of said jamb and are of conventional construction.

The novel structure herein will now be described. The end wall 37 has a projecting portion **37*a* which extends outwardly of the window frame 10 to extend along the outer side of the side sash rail 20*a*** as illustrated.

Figure 5:
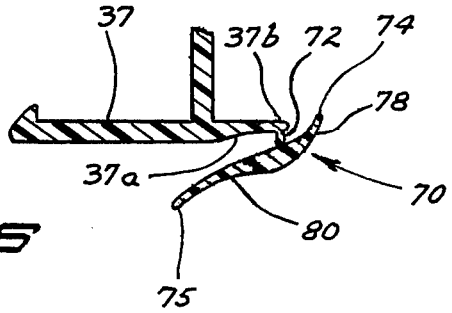
FIG. 5 is a view in horizontal section of a detail of structure on an enlarged scale.

Secured to the free end of said projecting portion **37*a* is said flexible seal or sealing strip member 70 formed as of a suitable flexible plastic material such as polyvinyl chloride which has good weathering qualities. More specifically said seal member has a small underlying rib portion 72 as shown in FIG. 5, which is fused in a conventional manner to the free end 37*b* of the projecting portion 37*a* substantially at right angles thereto in the direction away from the sash rail 20*a***. Thus said seal member is carried by said projecting portion hinged at said rib portion.

Said seal member has tapered side edge portions 74 and 75 as here shown for close adherence to the adjacent sash rail and jamb. Said underlying rib 72 is off center transversely of said seal member 70 to be adjacent the edge portion 74 providing a relatively short or narrow seal portion 78 to engage the sash rail **20*a* and a seal portion 80 of greater width engaging the adjacent side 12 of the window frame 10. Said seal member 70 has an overall width greater than the corresponding angled distance between the sash rail 20*a* and the engaged side window frame portion 12 with regard to the outer end of said projection 37*a* whereby said seal member is drawn inwardly of said projection 37*a*** under sufficient tension to provide a weather tight seal.

Under the impact of wind pressure, said seal member 70 is pressed more firmly against said adjacent rail portion **20*a*** and the adjacent side portion and thus increases in effectiveness as a weather seal.

It is believed that the operation of said weather seal 70 has been made clear in the above description. Said seal structure has proved to be successful in forming a very effective weather seal without restricting or binding the movement of the sash.

It will of course be understood that various changes may be made in the form, details, arrangement and proportions of the product without departing from the scope of applicant's invention which, generally stated, consists in a structure capable of carrying out the objects above set forth, such as disclosed and defined in the appended claims.

What is claimed is:

1. A weather seal structure for the juncture between a sash and the side of a window frame comprising a rigid jamb member disposed in a window frame, means holding said jamb member, a projection integral with said jamb member extending between the sash and the adjacent side of said window frame, a flexible strip weather seal member extending along said projection of said jamb member integral therewith, said seal member having a side portion thereof at one side of said projection bearing against said sash, and said seal member having a portion at the other side of said projection bearing against said adjacent side of said window frame.

2. The structure set forth in claim 1, wherein said seal member has a width greater than the corresponding distance between the engaged surfaces of said sash and said window frame and thus being drawn inwardly under tension into engagement with said sash and said side of said window frame.

3. The structure set forth in claim 1, wherein said seal member has an underlying rib portion secured to said projection.

4. The structure set forth in claim 3, wherein said rib portion is disposed angularly to said projection.

5. The structure set forth in claim 3, wherein said rib portion is disposed substantially at right angles to said projection in a direction away from said sash.

* * * * *